United States Patent [19]

Corey

[11] Patent Number: 4,913,304

[45] Date of Patent: Apr. 3, 1990

[54] COVER FOR POP TOP CAN

[76] Inventor: John L. Corey, 17700 S. Avalon Blvd. #55, Carson, Calif. 90746

[21] Appl. No.: 362,339

[22] Filed: Jun. 5, 1989

[51] Int. Cl.[4] ..... B65D 45/00

[52] U.S. Cl. ..... 220/246; 220/243; 220/250

[58] Field of Search ..... 220/243, 246, 250, 254, 220/258, 314, 90.2, 90.4, 90.6, DIG. 1 P; 222/511; 215/294

[56] References Cited

U.S. PATENT DOCUMENTS

| | | | |
|---|---|---|---|
| 1,102,879 | 7/1914 | Conger | 215/294 |
| 1,715,136 | 5/1929 | Leinbach | 222/511 |
| 1,844,053 | 2/1932 | Beatty | 215/294 |
| 2,080,769 | 5/1937 | Fitts | 220/243 X |
| 2,224,296 | 12/1940 | Hoffman | 220/DIG. 1 P X |
| 3,604,588 | 9/1971 | Winnick | 220/306 |
| 3,680,732 | 8/1972 | Dickie | 220/314 |
| 3,727,787 | 4/1973 | Gregory | 220/243 |
| 3,850,334 | 11/1974 | Wharton | 220/243 |
| 3,858,747 | 1/1975 | Wharton | 220/243 |
| 3,990,604 | 11/1976 | Barnett et al. | 220/307 |
| 4,429,804 | 2/1984 | Pease | 220/247 |

*Primary Examiner*—Stephen Marcus
*Assistant Examiner*—Nova Stucker
*Attorney, Agent, or Firm*—Charles H. Thomas

[57] ABSTRACT

A beverage container closure is provided for resealing beverage containers of the type having a peripheral rim encompassing a slightly recessed, apertured end wall through which the contents of the container are dispensed. The closure device includes a sealing member, or cover, constructed so as to sealably engage the rim portions of various sizes of containers and a cooperating interlocking mechanism which is adapted to be inserted through a dispensing aperture in the end wall of the container, and is constructed so that when it is inserted a portion of the interlocking mechanism is brought into engagement with the inner surface of the container end wall in a manner as to urge the cover into tight sealing engagement with the rim of the container.

14 Claims, 1 Drawing Sheet

COVER FOR POP TOP CAN

BACKGROUND OF THE INVENTION

1. Field of the Invention

This invention relates generally to container closure devices and more particularly to closure devices for use in resealing containers of the type used for packaging soft drinks, beer, fruit juices, and the like.

2. Description of the Prior Art

Containers made from a wide variety of materials and formed into numerous shapes and sizes have been used in the past for packaging soft drinks, beer and similar beverages. In recent years, containers made entirely of thin sheet metal, or made with nonmetallic body portions and thin metal end portions, have become increasingly popular for use in packaging soft drinks, beer and other beverages which are frequently consumed directly from the container. A feature which has significantly contributed to the popularity of such containers is the so-called "pull tab" dispensing arrangement which permits the opening of the container without the use of a can opener. In containers embodying this feature the top, or end wall, is scored to define a displaceable portion, which portion can be expeditiously opened by simply pulling upwardly on a tab or ring affixed to the end wall of the container. Since the displaceable portion cannot be replaced or resealed once the can is opened, the can cannot be resealed without using some type of auxiliary closure device. A similar resealing problem also, of course, exists with cans which are opened by means of can openers or the familiar lever-type beer can opener.

Various approaches have been taken to reseal beverage cans of both the pull tab and conventional solid end wall construction. These approaches typically involve various types of shaped plugs for insertion into the openings formed in the container, or providing various sizes of lids or covers which fit closely over the ends of the container. A principal drawback of these devices is that a given size or configuration of closure device can generally be used only with containers of a corresponding size or having openings therein of a certain configuration. None of the prior art devices known to the applicant has the advantage of being universal in the sense that a single closure device can be used with a wide variety of sizes of containers having variously configured openings therein.

Illustrative of the prior art approaches taken to reseal beverage cans are the devices described in the following patents which represent the closest art known to applicant, and which clearly demonstrate the novelty of applicant's highly unique container closure device:

| Patentee | Number | Issue Date |
|---|---|---|
| Reamy | 1,979,706 | June 14, 1933 |
| Stec | 3,419,181 | Nov. 7, 1967 |
| Angelus | 3,442,377 | March 1, 1968 |
| Winnick | 3,604,588 | Sept. 14, 1971 |
| Hayes | 3,606,074 | July 24, 1969 |
| Friedmann et al | 3,659,738 | May 2, 1972 |
| Lobl | 2,741,396 | April 10, 1956 |
| Hultgren | 1,123,646(U.K.) | Aug. 14, 1968 |
| Wheeler | 2,765,951 | Oct. 9, 1956 |
| Callegari | 3,476,284 | Nov. 4, 1969 |

SUMMARY OF THE INVENTION

It is a basic object of the present invention to provide a simple and inexpensive universal container closure device for use in quickly, easily and effectively resealing various sizes of beverage containers of the type characterized by having a peripheral flange, or rim, which encompasses an aperatured, recessed end wall portion through which the contents of the container are dispensed.

It is a particular object of the invention to provide a container in which the beverage container, after having once been opened, is effectively sealed to atmosphere by means of a sealing member, or cover, which is adapted to sealably engage only the outwardly extending surface of the peripheral flange of the container. This type of novel construction permits containers of various diameters to be effectively resealed by a closure device of a single configuration.

It is another object of the invention to provide a container closure device of the type described in the preceding paragraph which comprises a minimum number of parts and which features a unique interlocking mechanism for holding the sealing member in sealing engagement with the container. The interlocking mechanism is affixed to the sealing member and is adapted to be inserted into an aperture in the end wall of the container. When in place within the aperture, a portion of the interlocking mechanism bears firmly against the inner surface of the end wall of the container so as to hold the sealing member securely in sealing engagement with the peripheral flange, thereby effectively sealing the interior of the container to the atmosphere.

In summary, these and other objects of the invention are realized by a container closure device for sealing a container having an aperatured wall including a first sealing member for sealably engaging an exposed surface of the container at a location remote from the aperture therein, and a second or interlocking member connected to the first member and adapted to be inserted through the aperture in the container in a manner so as to engage the wall of the container and urge the first member into sealable engagement with the exposed surface of the container.

DESCRIPTION OF THE EMBODIMENTS AND IMPLEMENTATION OF THE METHOD

Figure 1:
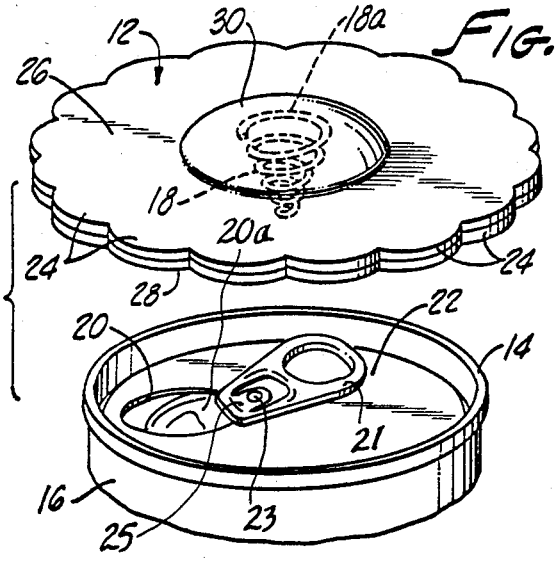
FIG. 1 is an exploded view of the container closure device of the invention shown in perspective as it would appear prior to moving it into mating engagement with an opened beverage container of the type characterized by having a peripheral rim encompassing a recessed aperatured wall.
Figure 2:
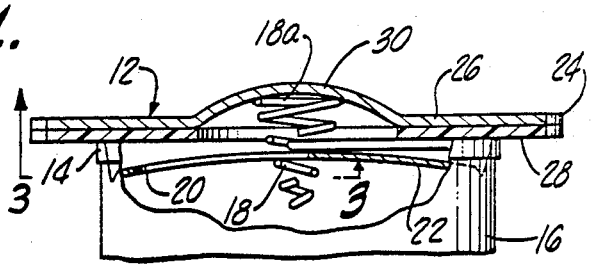
FIG. 2 is a side view partially in section and particularity broken away to show internal construction illustrating the container closure device as it appears when it is sealably interconnected with and sealing to atmosphere a beverage container or can.
Figure 3:
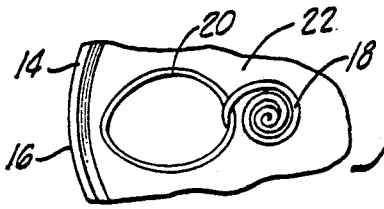
FIG. 3 is a view taken along lines 3—3 of FIG. 2 illustrating the way in which the interlocking means of the invention engages the inner surfaces of the end wall of the container.

Referring now to FIGS. 1, 2, and 3 of the drawings which illustrate one form of the invention, the container closure device can be seen to comprise a first, or sealing means, shown here in the form of a disc-shaped cover member 12 for sealably engaging an exposed surface such as the rim portion 14 of an opened beverage container 16 so as to seal the container to atmosphere. A second, or interlocking means, provided in this embodiment in the form of a yieldable tapered helical coil spring 18 is secured to the cover 12 and is adapted to be inserted through the aperture 20 in the end wall 22 of the beverage container in a manner so as to urge the cover into sealable engagement with the exposed upwardly facing edge of the rim portion 14 of the container 16.

The container closure device shown in the drawings is particularity suited for use in closing to atmosphere opened steel or aluminum containers of the type shown in FIG. 1 characterized by having a peripheral rim 14 encompassing a recessed aperture end wall 22 and having an opening of the configuration illustrated. As previously noted, in beverage containers having the "pull tab" opening arrangement, the top or end wall is scored to define a removable or depressible portion **20*a*, generally of the shape indicated in FIG. 1**.

In some containers of a type not shown, the scored portion is removed by pulling upwardly on a tab or ring affixed to the removable portion. The scored portion with the pull ring attached thereto may then be discarded as a unit. More typically in containers of the type currently manufactured, however, the scored portion **20*a*, is depressed inwardly by means of a pull tab 21 which is attached to the end wall by a rivet 23 which is fastened to a tab 25 on the pull tab 21. The tab 25 lies out of the plane of the remaining portion of the pull tab 21 and is stamped in an intermediate region thereof. At the extremity of the pull tab 21** remote from the scored portion there is a stamped opening to provide a finger grip.

To open the container 16 the finger grip on the tab 21 is pulled upwardly. The pull tab 21 does not separate from the end wall 22, but to the contrary remains fastened thereto by rivet 23. The pull tab 21 thereby acts as a lever which rotates about the rivet 23, which serves as a fulcrum. The end of the pull tab 21 proximate to the depressible scored portion thereby counter-rotates downwardly to push the scored portion **20*a* downwardly beneath the level of the end wall 22. The scored portion 20*a* does not separate totally from the end wall, but rather is folded back beneath the end wall 22, thereby creating an opening 20 from which the contents of the beverage container 16 may be withdrawn. It should be noted that in many beverage containers the opening 20 does not extend to the center of the end wall 22, but rather is radially offset from the end wall center as illustrated in FIG. 3**.

When it is desired to reseal the open container 16, the free tip of the interlocking means, which is the spring 18, is preferably introduced eccentrically into the aperture 20 in the end wall 22 and the cover member 12 is moved laterally as far toward the center of the end wall 22 as possible and then rotated relative to the container 16 in a manner as to cause the spring 18 to threadably enter the aperture. When the assemblage reaches the position shown in FIGS. 2 and 3, the cover member 12 will be securely held in sealable engagement due to the urging of the spring 18 which serves as a biasing means for urging the cover 12 into sealing engagement with the container 16. Also, as shown in FIG. 2 the yieldable end wall 22 of the container 16 is deformed slightly contributing to the tight sealing engagement of the cover member 12 and the container 16.

The corkscrew shape of the spring 18 is such as to circumscribe a conical volume, and the structure of the spring 18 itself serves as a centerless inclined plane. As the disc shaped cover member 12 is rotated, the interior portion of the yieldable end wall 22 is in effect pulled up the centerless inclined plane formed by the spring 18, thereby drawing the cover member 12 and the container end wall 22 together with a tensile force transmitted through the portion of the structure of the spring 18 lying between the cover member 12 and the top side of the end wall 22.

Since the spring 18 circumscribes a conical volume, the point of contact between the spring 18 and the underside of the yieldable end wall 22 will be located radially or eccentrically removed from the center of the end wall 22, as illustrated in FIG. 3. The radial displacement of the point of contact of the spring 18 with the underside of the end wall 22 increases as the cover member is rotated to advance the spring 18 into the interior of the container 16. The radial displacement of the point of contact is advantageous, since the opening 20 is likewise normally displaced from the center of the end wall 22. As a consequence, although the point of contact between the spring 18 and the underside of the end wall 22 is radially displaced from the center of the end wall 22, the center of the cover member 12 is very nearly coaxial with the center of the end wall member 22. As a consequence, the compressive force acting between the underside of the cover member 12 and the rim portion 14 of the beverage container 16 is very nearly uniform about the entire interface therebetween. This uniformity of pressure between cover member 12 and the rim 14 increases the effectiveness of the seal therebetween since the integrity of the entire seal is no greater than that at the point of least pressure acting between the cover member 12 and the rim 14.

Means for gripping the cover member 12, shown here in the form of scallops 24 formed around the periphery of the cover member, are provided to assist expeditious rotational movement of the cover relative to the container so as to permit the cover to be securely snugged down into sealing position against the container rim 14. The large surface area of the top of the cover member 12 provides an ideal space for an advertizing message. For example, the name and logo of a beverage manufacturer may be printed on the top surface of the cover member 12.

Since all sealing engagement between the cover member 12 and the rim 14 is effectuated by contact between the underside of the cover member 12 and the upwardly facing circular annular edge of the rim 14, the cover member 12 may be utilized with containers of varying diameter. Unlike some prior art beverage container closure devices, the cover member 12 requires no interaction with the cylindrical surface of either the rim 14 or the wall of the beverage container 16. Consequently, the only restriction on the diameter of the container 16 with which the cover member 12 may be employed is that the diameter of the container 16 can be no greater than the cover member 12. However, the diameter of the container 16 may be of any size smaller than the diameter of the cover member 12. Furthermore, the device of the invention can reused indefinitely and has no moving parts. It can be manufactured extermely economically.

The sealing means or cover in the embodiment of the invention as depicted in FIGS. 1–3 is constructed of an upper portion 26 and an interconnected lower portion 28. Upper portion 26 has a centrally disposed dome-shaped section 30 which is configured to receive for interconnection the base portion 18*a* of spring 18. Lower portion 28 is annular-shaped so as to permit spring 18 to protrude through its central opening and is preferably constructed of a yieldable material which serves as a gasket and will sealably conform to the shape of rim 14 when the cover 12 is drawn into sealable engagement with the container 16.

It should be noted that the dome-shaped section 30 of the cover member 12 provides a cavity beneath the cover 12 and the upper end wall 22 of the container 16 sufficient to accommodate a large portion of the spring 18 and also the pull tab 21 atop the upper end wall 22. It is important for clearance to exist between the tab 21 and the cover member 12 so that the force of the spring 18 effectuates sealing engagement of the cover member 12 against the rim 14, and not merely a force against the pull tab 21. The dome-shaped center section 30 allows the peripheral portion of the cover member 12 to bear directly against the rim 14 while clearance still exists above the pull tab 21 and the cover member 12. This feature enhances the integrity of the seal across the top of the container 16.

Figure 4:
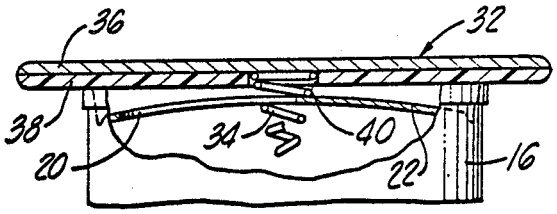
FIG. 4 is a side view partially in section and partially broken away showing another form of the invention.

Referring to FIG. 4, there is shown another form of the invention in which the sealing means comprises a generally planar disc-shaped cover member 32 and the interlocking means comprises a yieldable tapered spring member 34 of similar construction to that of previously identified spring member 18. In this embodiment, member 32 also has upper and lower interconnected, generally planar-shaped portions 36 and 38. Lower portion 38 is provided with a central opening 40 adapted to receive the base portion of the spring member 34, and is also preferably constructed of a yieldable material such as, for example, plastic, rubber or yieldable composite material which will sealably conform to the rim of the container. Interconnection of cover member 32 with the container 16 is accomplished in the same manner as discussed with reference to the previously described embodiment.

Figure 5:
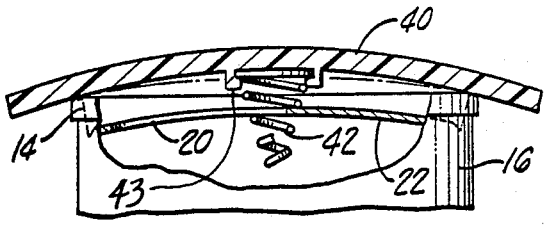
FIG. 5 is a side view partially in section and partially broken away showing another form of the invention in which the sealing means is curved or dome-shaped.

In FIG. 5 there is shown yet another form of the container closure device. In this embodiment of the invention the sealing means is provided in the form of a single piece of curved or dome-shaped member 40 to which the interlocking means or tapered helical coil spring member 42 is attached by means of an annular lip 43 integrally formed on the underside of the dome-shaped plastic member 40. The lip 43 defines an annular recess which receives the largest end coil of the spring member 42. The interior edge is chamfered so as to aid in guiding the largest end coil of the spring member 42 into the annular recess defined by the lip 43. The lip 43 thereby secures the tapered helical coil spring 42 to the dome-shaped member 40.

In the form of the invention of FIG. 5 the cover member 40 is constructed of a yieldable material and comprises biasing means which, in cooperation with tapered helical coil spring 42, serves to urge the lower surface of the cover member into sealing engagement with the rim of the container when the coil spring is threadably inserted into the aperture in the end wall 22 of the container 16. Like the springs 18 and 34, the spring 42 serves as a helical, inclined plane. Also, all of the cover members 12, 32, and 40 will accommodate rims 14 extending to different heights above the end wall 22 by merely varying the extent to which the spring member is advanced into the opening 20.

The dome-shaped cover member 40, in the embodiment of FIG. 5, like that of FIGS. 1∝3, provides a clearance between the underside of the cover member and the pull tab 21 atop the end wall 22. The force of the spring 42 is thereby exerted against the rim 14 and not the pull tab 21, thereby strengthening the sealing effect.

Figure 6:
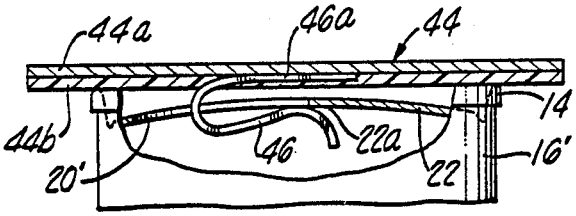
FIG. 6 is a side view partially in section and partially broken away showing a container closure device embodying an interlocking means of different configuration.

Turning to FIG. 6, there is shown another form of the container closure device of the invention utilized with a container 16' having a beverage dispensing opening 20' of a modified configuration. As illustrated in the drawings, the sealing means is in the form of cover member 44 of the two-piece construction similar to that shown in FIG. 4 and previously described herein. The interlocking means, however, in this embodiment, is provided in the form of a yieldable, generally flat spring member 46 so constructed and arranged as to be inserted into the aperture 20' in the container 16 for engagement with the inner surface 22*a* of the end wall 22 of the container at a location proximate the aperture therein. One end 46*a* of spring member 46 is connected to the upper portion 44*a* of the cover member near its center point and depends downwardly through an opening in the lower portion 44*b* of the cover member.

In affixing the device to the container so as to seal it to the atmosphere, the free end of spring member 46 is first inserted into the opening of the container end wall and then the cover member is urged toward the right, as viewed in FIG. 6, until the assemblage reaches the position shown in the drawing. In this orientation, a portion of the spring member engages the inner surface of the container end wall, and, because of the unique curved configuration of the spring as shown, exerts a uniform all-around pressure on the end wall of the container urging the cover member into tight sealing engagement with the rim 14 of the container.

Figure 8:
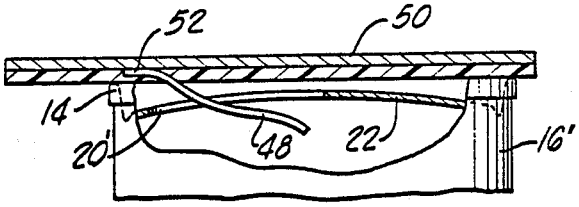
FIG. 8 is a view taken along lines 8—8 of FIG. 7.
Figure 7:
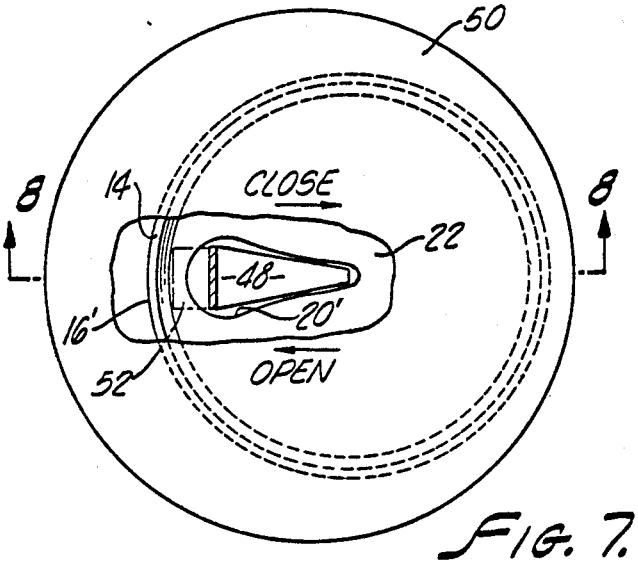
FIG. 7 is a plan view partially broken away showing still another form of the invention.

FIGS. 7 and 8 show still another form of closure deice of similar construction to that described in the immediately preceding paragraphs. In this embodiment, however, the interlocking means is provided in the form of a flat spring 48 of slightly different configuration. As best seen in FIG. 8, spring 48 is constructed of a generally flat yieldable material, one end of which is affixed to a cover member 50 at an off-centered location 52. The spring member 48 is constructed so that it depends downwardly from cover member 50 and forms an acute angle relative thereto. The configuration of the spring member is such that it can be inserted into the aperture in the end wall 22 of the container 16, as shown in FIG. 8. By moving the assemblage to the right in the direction of the "close" arrow (FIG. 7) to a centered position, the spring member will engage the inner surface of the end wall of the container adjacent the opening and, because of the novel configuration of the spring body, will urge the cover into tight sealing engagement with the container.

Figure 9:
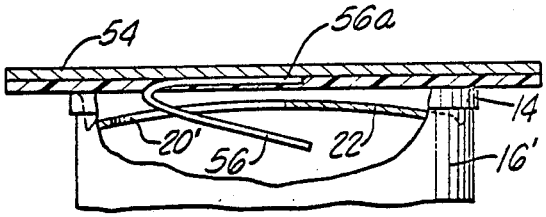
FIG. 9 is a side view partially in section and partially broken away illustrating yet another embodiment of the container closure means of the invention.

In FIG. 9 there is illustrated yet another form of the invention. The sealing means is again in the form of a planar cover member 54 adapted to sealably engage the rim 14 of the container 16. The interlocking means, however, provided in the form of a spring member 56 is of a slightly different design from those previously described. The upper end 56*a* of the spring member is affixed to the cover member 54 near its center end and is bent back upon itself in a generally "C"-shaped cross-sectional configuration.

As in the case of previously described embodiments, the closure device is affixed to the container by inserting the free end of the spring member into the aperture of the container and then sliding the assemblage into a centered position so that the spring engages the inner surface of the end wall of the container, and due to its configuration urges the cover member into sealing engagement with the container.

Although in the drawings a container having the pull-tab type of opening arrangement is illustrated, it is to be appreciated that the container closure device of the invention as described in the preceding paragraphs can be used equally well to seal containers having differently shaped apertures. Also, it is to be understood that by varying the diameter of the sealing means, the device of the invention can be used to effectively seal open containers through engagement of the sealing means with the upper surface of the end wall of the container proximate the opening and within the rim portion. Additionally, the device of the invention can easily be adapted for use in the sealing containers having a flat top or end wall, rather than the recessed end wall construction shown in the drawings. It is this high degree of versatility of the invention which serves to enhance its commercial value and also to distinguish it from prior art devices.

I claim:

1. A container closure device for resealing containers of the type characterized by having a peripheral rim having a radially outwardly facing surface and an annular end edge surface transverse to said outwardly facing surface encompassing a recessed, end wall permanently secured to said rim and defining an off center aperture therein comprising:

a sealing means for sealably engaging the peripheral rim of the container so as to seal the container to atmosphere; and an interlocking means operatively associated with said sealing means for holding said sealing means in sealable engagement with the peripheral rim of the container, said interlocking means being adapted for removable insertion into the aperture in the end wall of the container for engagement with the inner surface of the container end wall in a manner so as to hold said sealing means in sealing engagement with only said end edge surface of the peripheral rim of the container.

2. A container closure device as defined in claim 1 in which said sealing means comprises biasing means for urging said sealing means into sealing engagement with the peripheral rim of the container.

3. A container closure device as defined in claim 1 in which said interlocking means comprises biasing means adapted for resilient deformation in tension for urging said sealing means into sealable engagement with said end edge surface of the peripheral rim of the container.

4. A container closure device as defined in claim 1 in which said interlocking means is formed of a yieldable spring member having an anchored end and an opposite free end and said anchored end is secured to said sealing means and said free end extends outwardly from said sealing means and is adapted to be inserted into the aperture in the end wall of the container for engagement with the inner surface of the end wall in a manner so as to exert tension on said spring member to thereby draw said sealing means into sealable engagement with the peripheral rim of the container.

5. A container closure device as defined in claim 4 in which said yieldable spring member comprises a tapered helical coil spring in which said anchored end is a broadest end and said spring tapers therefrom to form a freely extending tip at said free end.

6. A container closure device as defined in claim 3 in which said sealing means comprises a generally planar-shaped cover member having a container rim engaging portion adapted to yieldably conform to the shape of the container rim and being provided with means for gripping said cover member for expeditious rotational movement thereof relative to the container.

7. A container closure device for resealing containers of the type characterized by having a peripheral rim with an end edge surface encompassing a recessed, aperture end wall comprising:

a sealing means for sealably engaging the peripheral rim of the container so as to seal the container to atmosphere; and an interlocking means operatively associated with said sealing means for holding said sealing means in sealable engagement with the peripheral rim of the container, said interlocking means being adapted to be inserted into an aperture in the end wall of the container for engagement with the inner surface of the container end wall in a manner so as to hold said sealing means in sealing engagement with only said end edge surface of the peripheral rim of the container, wherein said interlocking means is comprised of biasing means for urging said sealing means into sealable engagement with the peripheral rim of the container and wherein said biasing means comprises a yieldable, generally flat spring member so constructed and arranged as to be inserted into the aperture in the container for engagement with the inner surface of the end wall thereof at a location proximate the aperture therein.

8. A container closure device for sealing to atmosphere a container having a rim with a radially outwardly facing surface and an upwardly facing transverse exposed end surface surrounding and permanently secured to an end wall with an aperture defined at an off-center location therewithin, comprising:

a first means for sealably engaging said exposed end surface of the container; and a second means connected to said first means and adapted to be removably inserted through the aperture in the wall of the container in a manner so as to engage the container and urge said first means into sealable engagement with only said upwardly facing transverse exposed end surface of the container.

9. A container closure device as defined in claim 8 in which said second means includes biasing means adapted for resilient deformation in tension for urging said first means into sealing engagement with the container.

10. A container closure device as defined in claim 8 in which said second means is comprised f a tapered, helical coil spring having a freely extending coil of smallest diameter at an exposed end and a coil of largest diameter at an opposite end anchored to said first means.

11. A container closure device as defined in claim 10 wherein said first means is comprised of a unitary molded plastic structure having an underside formed with an annular lip at its center, wherein said lip receives and captures said largest coil of said helical spring.

12. A container closure device as defined in claim 8 in which said first means comprises a dome-shaped cover member adapted to sealably engage a peripheral end portion of the container.

13. A container closure device as defined in claim 8 in which said first means comprises a generally planar-shaped first member and a generally planar-shaped second member connected to said first member, said second member being constructed of a yieldable material adapted to sealably engage a peripheral end portion of the container.

14. A container closure device for sealing to atmosphere a container having an exposed end surface surrounding an aperture wall, comprising:

a first means for sealably engaging the exposed end surface of the container at a remote location from the aperture; and a second means connected to said first means and adapted to be inserted through the aperture in the wall of the container in a manner so as to engage the container and urge said first means into sealable engagement with only the exposed end surfaces of the container, wherein said second means is comprised of a tapered, helical coil spring having a coil of smallest diameter at an exposed end and a coil of largest diameter at an opposite end, and said first means is comprised of a unitary molded plastic structure having an underside formed with an annular lip at its center, wherein said lip receives and captures said largest coil of said helical spring.

* * * * *